US010125710B2

(12) United States Patent
Hu et al.

(10) Patent No.: US 10,125,710 B2
(45) Date of Patent: Nov. 13, 2018

(54) DETECTION OF REVERSION BASED ON MASS AIR FLOW SENSOR READINGS

(71) Applicant: GM GLOBAL TECHNOLOGY OPERATIONS LLC, Detroit, MI (US)

(72) Inventors: Yiran Hu, Shelby Township, MI (US); Shifang Li, Shelby Township, MI (US); Chen-Fang Chang, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 692 days.

(21) Appl. No.: 14/623,817

(22) Filed: Feb. 17, 2015

(65) Prior Publication Data

US 2016/0237940 A1 Aug. 18, 2016

(51) Int. Cl.

| | |
|---|---|
| ***F02D 41/18*** | (2006.01) |
| *F02M 35/10* | (2006.01) |
| *F02D 41/28* | (2006.01) |

(52) U.S. Cl.

CPC ..... *F02D 41/18* (2013.01); *F02D 2041/286* (2013.01); *F02D 2200/0406* (2013.01); *F02M 35/1038* (2013.01); *F02M 35/10386* (2013.01)

(58) Field of Classification Search

CPC ..... F02D 41/187; F02D 41/18; F02D 41/182; F02M 26/47; F02M 35/10386

See application file for complete search history.

(56) References Cited

U.S. PATENT DOCUMENTS

| | | | | |
|---|---|---|---|---|
| 6,839,643 | B2 * | 1/2005 | Kanke | G01F 1/6845 701/102 |
| 6,990,856 | B2 | 1/2006 | Dempsey et al. | |
| 2004/0250610 | A1 * | 12/2004 | Dempsey | F02D 41/182 73/114.34 |

FOREIGN PATENT DOCUMENTS

| | | | |
|---|---|---|---|
| JP | 08218934 | * | 8/1996 |
| JP | 11083584 | * | 3/1999 |

* cited by examiner

*Primary Examiner* — Matthew Reames
*Assistant Examiner* — Steven B Gauthier
(74) *Attorney, Agent, or Firm* — Quinn IP Law

(57) ABSTRACT

An engine system includes a mass air flow sensor and a manifold absolute pressure sensor configured to provide a real-time MAP signal during an event. The mass air flow sensor is configured to generate a set of mass air flow readings based on an airflow through the mass air flow sensor during the event. The set of mass air flow readings have a maximum value and a minimum value. A controller is configured to execute a method for detecting reversion in the air flow. If the rate of change in the real-time MAP signal is less than the predetermined transient threshold value ($T_0$), the method includes setting a delta factor (D) as the difference between the maximum value and the minimum value. Reversion is detected based at least partially on a magnitude of the delta factor (D).

19 Claims, 2 Drawing Sheets

DETECTION OF REVERSION BASED ON MASS AIR FLOW SENSOR READINGS

TECHNICAL FIELD

The disclosure relates generally to detecting reversion based on mass air flow sensor readings, and more specifically, to detecting reversion based on real-time mass air flow sensor readings in an engine system.

BACKGROUND

A vehicle typically includes an engine with an air intake manifold and an air inlet, such that air flows into the intake manifold through the air inlet. Mass air flow sensors may be used to measure the mass of air flowing through the air inlet into the engine. Reversion is the reverse flow of air from the intake manifold back through the air inlet. Reversion may lead to unreliable mass air flow sensor readings.

SUMMARY

An engine system includes a mass air flow sensor and a manifold absolute pressure sensor configured to provide a real-time manifold absolute pressure (MAP) signal during an event. The event may be an engine intake event. The mass air flow sensor is configured to generate a set of mass air flow readings based on an airflow through the mass air flow sensor during the event. The set of mass air flow readings has a maximum value and a minimum value. A controller is operatively connected to the mass air flow sensor and a manifold absolute pressure (MAP) sensor. The controller has a processor and tangible, non-transitory memory on which is recorded instructions for executing a method for detecting reversion in the air flow.

Execution of the instructions by the processor causes the controller to (i.e., the controller is configured to) determine whether a rate of change in the real-time MAP signal is greater than or equal to a predetermined transient threshold value ($T_0$). If the rate of change in the real-time MAP signal is less than the predetermined transient threshold value ($T_0$), the method includes setting a delta factor (D) as the difference between the maximum value and the minimum value. Reversion is detected based at least partially on a magnitude of the delta factor (D). The method requires calibration only for the individual mass air flow sensor rather than for each engine system. Thus each mass air flow sensor may be used with multiple engine systems with a single calibration.

The controller may be configured to set up a reversion zone flag (R) such that presence of the reversion is indicated by the reversion zone flag being one (R=1) and absence of the reversion is indicated by the reversion zone flag being zero (R=0).

If the delta factor (D) is greater than or equal to the entry threshold value for less than a first number of consecutive events, the controller is configured to make no change to the reversion zone flag. If the delta factor (D) is greater than or equal to the entry threshold value for at least the first number of consecutive events, the controller is configured to set the reversion zone flag to one (R=1).

If the delta factor (D) is less than or equal to the exit threshold value for less than a second number of consecutive events, the controller is configured to make no change to the reversion zone flag. If the delta factor (D) is less than or equal to the exit threshold value for at least the second number of consecutive events, the controller is configured to set the reversion zone flag to zero (R=0).

If the rate of change in time of the real-time MAP signal is greater than or equal to a predetermined transient threshold value ($T_0$), the controller is configured to determine if a predefined open throttle condition is met. If the predefined open throttle condition is not met, the controller is configured to set the reversion zone flag to zero (R=0). The predefined open throttle condition may be defined by the throttle valve being greater than 90% open. The predefined open throttle condition may be defined by a pressure downstream of the throttle valve being 90% greater than a pressure upstream of the throttle valve. If the predefined open throttle condition is met, the controller is configured to set the delta factor (D) as the difference between the maximum value and the minimum value of the set of mass air flow readings.

The above features and advantages and other features and advantages of the present disclosure are readily apparent from the following detailed description of the best modes for carrying out the disclosure when taken in connection with the accompanying drawings.

DETAILED DESCRIPTION

Figure 1:
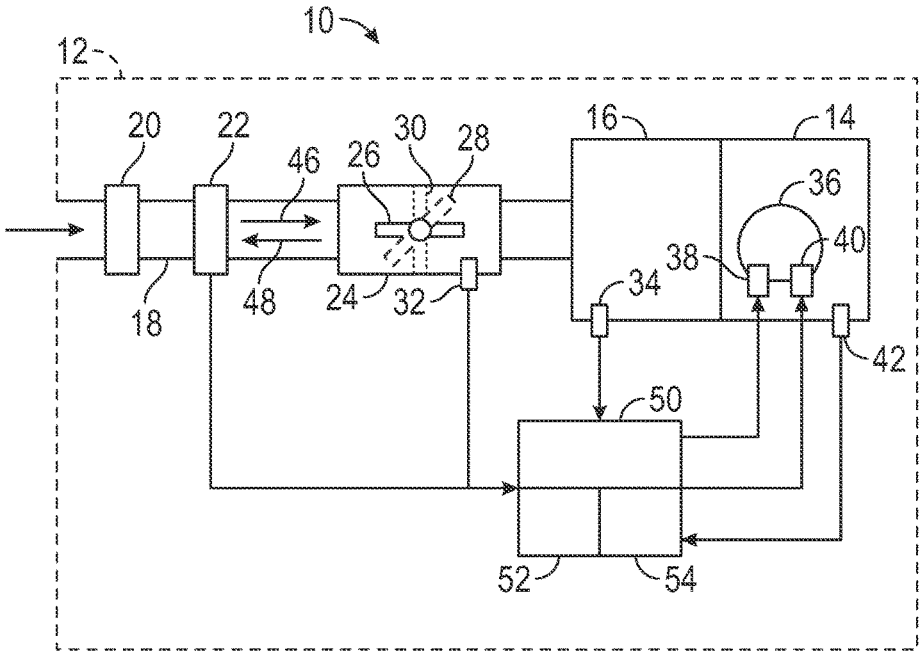
FIG. 1 is a schematic fragmentary view of a vehicle having an engine with an intake manifold and a mass air flow sensor.

Referring to the Figures, wherein like reference numbers refer to the same or similar components throughout the several views, FIG. 1 shows a vehicle 10 having an engine system 12. The engine system 12 includes an engine 14 and an intake manifold 16. An air inlet 18 enables a flow of air into the intake manifold 16 from an external source, such as the atmosphere. An air filter 20, a mass air flow sensor 22 and a throttle valve 24 are located along the air inlet 18.

Referring to FIG. 1, the air filter 20 filters the air as it passes through the air inlet 18 to the engine 14 to remove dirt or debris. The throttle valve 24 is adjustable to regulate the air flowing into the intake manifold 16. The throttle valve 24 may include an electronically controlled device that controls airflow to the engine 14 in response to a control signal from the controller 50. The throttle valve 24 is shown in fully open position 26 (solid line), half open position 28 (dashed line) and closed position 30 (dashed line). A throttle position sensor 32 may be used to detect the position/opening of the throttle. The throttle position sensor may have an output voltage that varies with the position of the throttle valve 24.

Referring to FIG. 1, a controller 50 is operatively connected to the mass air flow sensor 22 and various other components of the engine 14. The controller 50 may be an integral portion of, or a separate module operatively connected to, other control modules of the vehicle 10, such as the engine control module. The vehicle 10 may be any passenger or commercial automobile such as a hybrid electric vehicle, including a plug-in hybrid electric vehicle, an extended range electric vehicle, or other vehicles. The vehicle 10 may take many different forms and include multiple and/or alternate components and facilities. While an example vehicle is shown in the Figures, the components illustrated in the Figures are not intended to be limiting. Indeed, additional or alternative components and/or implementations may be used.

Referring to FIG. 1, the engine 14 includes a cylinder 36 having a fuel injector 38 and a spark plug 40. Although a single cylinder is shown, it is to be understood that the engine 14 may include multiple cylinders with corresponding fuel injectors and spark plugs. The controller 50 adjusts the flow of fuel through the fuel injector 38 based on the air flowing into the cylinder 36 to control the air-fuel-ratio (AFR) within the cylinder 36. An air-fuel-ratio (AFR) sensor 42 may be operatively connected to the engine 14 and controller 50.

Referring to FIG. 1, the engine system 12 includes a manifold absolute pressure (MAP) sensor 34 which is operatively connected to the intake manifold 16 and capable of measuring and monitoring the pressure of the air inside the intake manifold 16. The manifold absolute pressure (MAP) sensor 34 is configured to provide a real-time MAP signal during an event. The event may be an intake event of the engine 14. As is known, the intake event for an engine is when the air-fuel mixture is introduced to fill the combustion chamber (not shown). The intake event may be defined as the time period from just before the intake valve (not shown) opens to just after the intake valve closes. The actual time period that this event corresponds to may vary with engine speed.

Referring to FIG. 1, the mass air flow sensor 22 is operatively connected to the intake manifold 16 and can measure the mass of air flowing through the air inlet 18 entering the intake manifold 16. The mass air flow sensor 22 is configured to generate a set of mass air flow readings based on an airflow through the mass air flow sensor 22 during the intake event of the engine 14. The respective sets of mass air flow readings each have a maximum value and a minimum value. Referring to FIG. 1, airflow towards the intake manifold 16 is indicated by forward airflow 46. Some air may flow away from the intake manifold 16 back through the air inlet 18 and is referred to as reversion. Airflow away from the intake manifold 16 is indicated by reverse airflow 48. Reversion may result in incorrect mass air flow sensor 22 readings.

Referring to FIG. 1, the controller 50 has a processor 52 and tangible, non-transitory memory 54 on which are recorded instructions for executing a method 100, described below with reference to FIG. 2, for detecting reversion in real-time, based on the readings of the mass air flow sensor 22. Any type of mass air flow sensor may be employed in the method 100.

Figure 2:
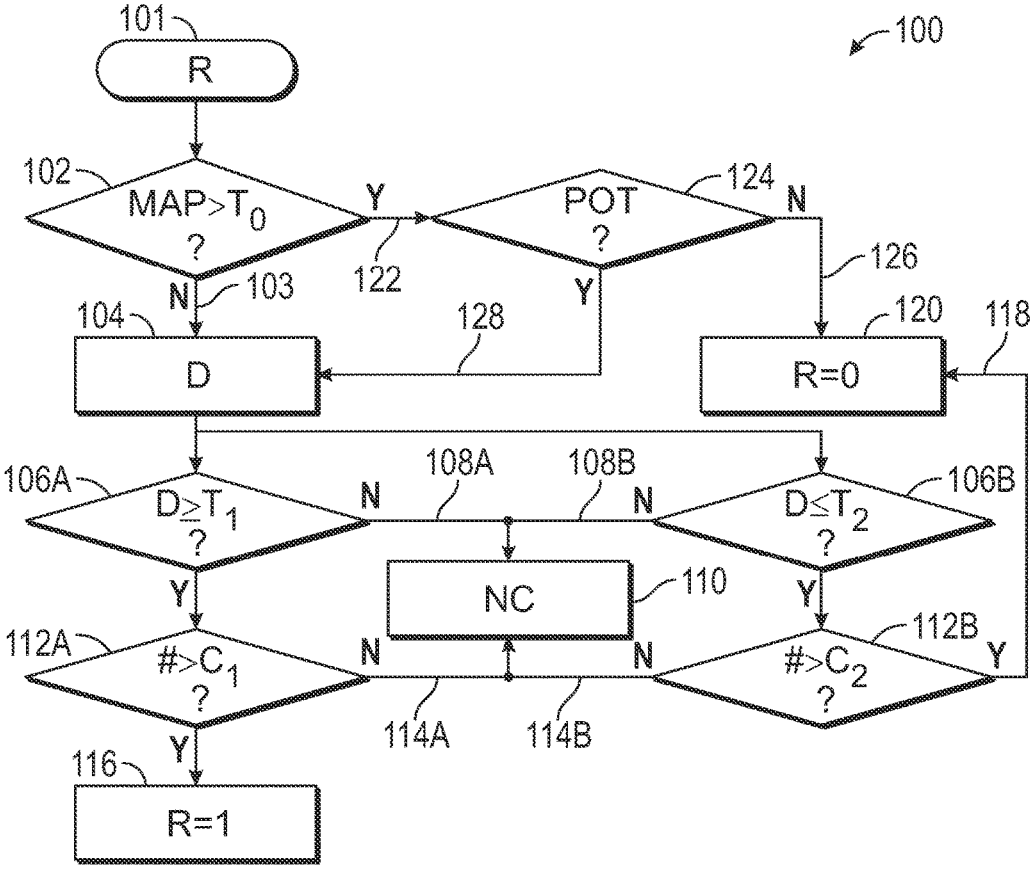
FIG. 2 is a flowchart for a method of detecting reversion based on the readings of the mass air flow sensor of FIG. 1.

Referring now to FIG. 2, a flowchart of a method 100 stored on and executable by the controller 50 of FIG. 1 is shown. Method 100 is described below with reference to FIGS. 1-2. The method 100 is employed to detect the reversion based at least partially on a delta factor (D) (i.e., the difference between the maximum value and the minimum value of the set of mass air flow readings for each respective intake event). Method 100 need not be applied in the specific order recited herein. Furthermore, it is to be understood that some steps or blocks may be eliminated. The letters "Y" and "N" in FIG. 2 indicate "yes" and "no," respectively.

Referring to FIG. 2, method 100 may begin with block 101 where the controller 50 sets up a reversion zone flag (R) such that presence of reversion is indicated by the reversion zone flag being one (R=1) and absence of reversion is indicated by the reversion zone flag being zero (R=0). The reversion zone flag (R) may be initialized with a zero value (R=0). Alternatively, the reversion zone flag (R) may be initialized with a "TBD" status (to be determined).

The method 100 proceeds to block 102 where the controller 50 determines whether a change in the real-time MAP signal (i.e., rate of change in time) is greater than a predetermined transient threshold value ($T_0$). As noted above, the manifold absolute pressure (MAP) sensor 34 is configured to provide a real-time MAP signal. An example for the transient threshold value ($T_0$) is when the previous MAP signal or measurement is more than 5 kPa from the current MAP signal or measurement.

If the change in the real-time MAP signal is less than (or equal to) the transient threshold value ($T_0$), the method 100 proceeds to block 104 of FIG. 2, as is indicated by line 103. In block 104, the controller 50 sets a delta factor (D) as the difference between the maximum value and the minimum value of the set of mass air flow (MAF) readings for each respective intake event. If the change in the real-time MAP signal is greater than the transient threshold value ($T_0$), the method 100 proceeds to line 122, to be described later.

After setting the delta factor (D) as the difference between the maximum value and the minimum value set of mass air flow (MAF) readings for each respective intake event per block 104 of FIG. 2, the method 100 proceeds to blocks 106A and 106B in parallel. In block 106A of FIG. 2, the controller 50 determines if the delta factor (D) is greater than or equal to an entry threshold value ($T_1$). If the delta factor (D) is less than the entry threshold value ($T_1$), the controller 50 is configured to make no change to the reversion zone flag, as indicated by line 108A and block 110 ("NC" indicates no change).

In block 112A of FIG. 2, the controller 50 determines if the delta factor (D) is greater than or equal to an entry threshold value ($T_1$) for at least a first number of consecutive events ($C_1$). If the delta factor (D) is greater than or equal to the entry threshold value ($T_1$) for less than the first number of consecutive events ($C_1$), the controller 50 is configured to make no change to the reversion zone flag, as indicated by line 114A and block 110.

If the delta factor (D) is greater than or equal to the entry threshold value ($T_1$) for at least the first number of consecutive events ($C_1$), the controller 50 is configured to set the reversion zone flag to one (R=1), as indicated in block 116. The first number of consecutive events ($C_1$) may be set to any value as needed, per the application. In one example, the first number of consecutive events ($C_1$) is three.

In block 106B of FIG. 2, the controller 50 determines if the delta factor (D) is less than or equal to an exit threshold value ($T_2$). If the delta factor (D) is greater than the exit threshold value ($T_2$), the controller 50 is configured to make no change to the reversion zone flag, as indicated by line 108B and block 110 ("NC" indicates no change).

In block 112B of FIG. 2, the controller 50 determines if the delta factor (D) is less than or equal to the exit threshold value ($T_2$) for at least a second number of consecutive events ($C_2$). If the delta factor (D) is less than or equal to the exit threshold value ($T_2$) for less than the second number of consecutive events ($C_2$), the controller 50 is configured to make no change to the reversion zone flag, as indicated by line 114B and block 110.

If the delta factor (D) is less than or equal to the exit threshold value ($T_2$) for at least the second number of consecutive events ($C_2$), the controller 50 sets the reversion zone flag to zero (R=0) in block 120, as indicated by line 118. The second number of consecutive events ($C_2$) may be set to any value as needed per the application. In one example, the second number of consecutive events ($C_2$) is four.

Referring now back to block 102, if the change in the real-time MAP signal is greater than or equal to the transient threshold value ($T_0$), the method 100 proceeds to block 124, as indicated by line 122. In block 124, the controller 50 determines if a predefined open throttle condition (indicated in FIG. 2 as "POT") is met. If the predefined open throttle condition is not met, the controller 50 is configured to set the reversion zone flag to zero (R=0). The predefined open throttle condition may be defined by a minimum opening size of the throttle valve 24. For example, the predefined open throttle condition may be defined by the throttle valve 24 being at least 90% open. The predefined open throttle condition may be defined by a minimum intake manifold pressure MAP signal, e.g. by a pressure downstream of the throttle valve 24 being 90% greater than a pressure upstream of the throttle.

In effect, when the engine 14 is in a transient state (i.e., the change in the real-time MAP signal is greater than the transient threshold value ($T_0$)) as indicated by line 122, the method 100 takes into account whether a predefined open throttle condition is met (in block 124). However, when the engine 14 is not in a transient state, the method 100 may be carried out to determine the delta factor (D) as per block 104 (to investigate the maximum and minimum flow to see if reversion is happening) regardless of the throttle condition.

Referring to line 126 of FIG. 2, if the predefined open throttle condition is not met in block 124, the controller 50 sets the reversion zone flag to zero (R=0) in block 120. Referring to line 128 of FIG. 2, if the predefined open throttle condition is met in block 124, the controller 50 sets the delta factor (D) as the difference between the maximum value and the minimum value, as indicated by block 104. The method 100 then proceeds to blocks 106A and 106B as described earlier. The method 100 may cycle continuously while the engine 14 is in operation.

Figure 3:
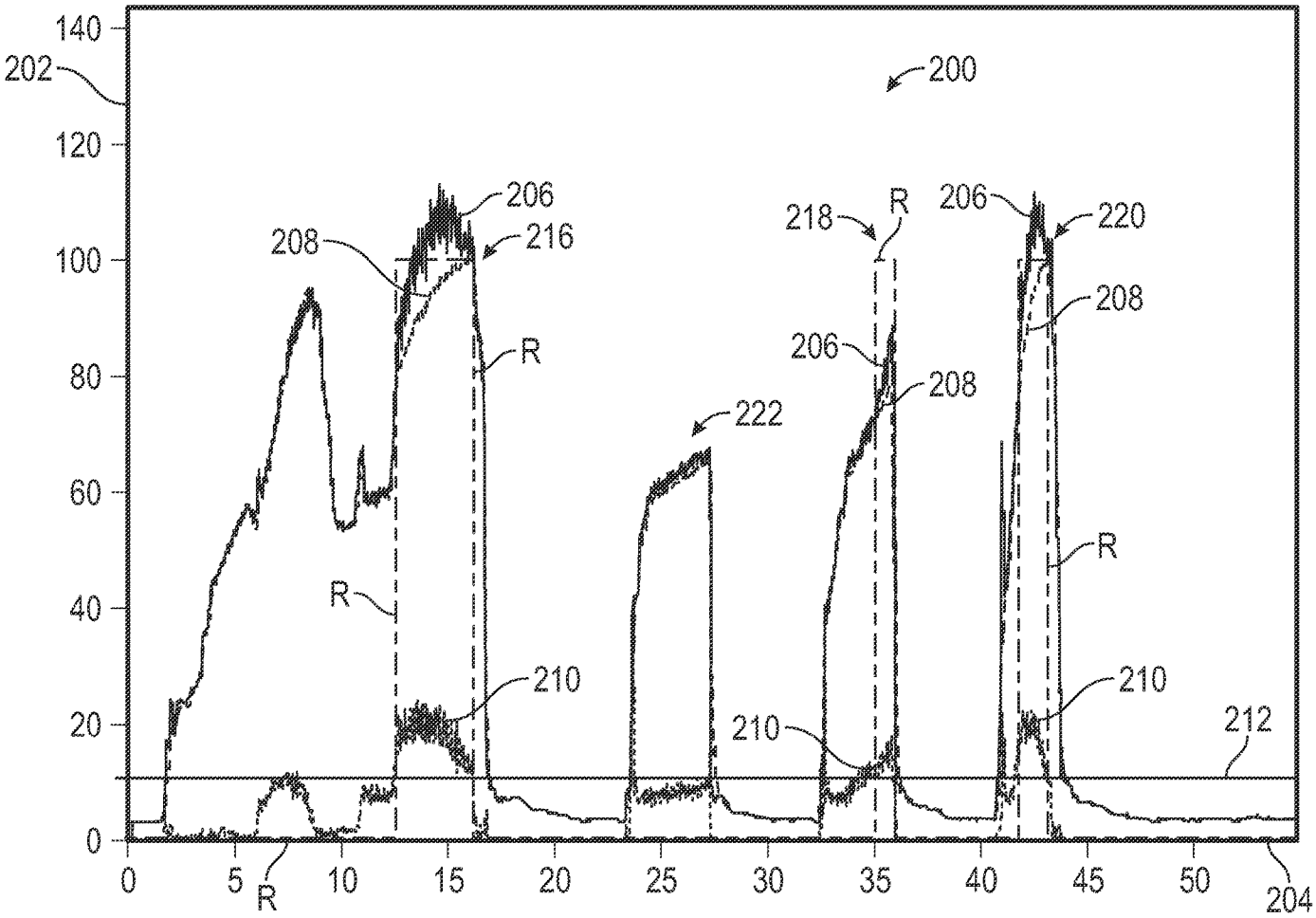
FIG. 3 is a set of graphs generated by a calibration set-up for determining entry and exit thresholds values ($T_1$, $T_2$) employed in the method of FIG. 2.

The entry and exit threshold values ($T_1$, $T_2$) in blocks 106A and 106B, respectively, depend on the characteristics of the particular mass air flow sensor being employed. The entry and exit thresholds values ($T_1$, $T_2$) may be determined by calibration. Referring to FIG. 3, a graph 200 of a calibration set-up for the entry threshold value ($T_1$) is shown. Axis 202 represents mass air flow in grams. Axis 204 represents time in seconds. The calibration set-up requires comparison of the signals from the mass air flow sensor 22, which is affected by reversion, and a calibration sensor which is not affected by reversion. The calibration sensor reading may be inferred from a wide range air-fuel-ratio (AFR) sensor measurement (such as with AFR sensor 42 shown in FIG. 1) of the engine 14 along with the amount of fuel injected by the fuel injector 38. Alternatively, the calibration sensor may be a laminar flow element (not shown) mounted in a test cell or laboratory. Laminar flow elements are generally constructed from an extensive number of parallel pipes.

Referring to FIG. 3, an example of the signal from the mass air flow sensor 22 over time is shown by first trace 206. An example of the signal from a calibration sensor is shown by second trace 208. The difference between the first and second traces 206, 208 is shown in third trace 210.

Referring to FIG. 3, the entry threshold value ($T_1$) (indicated by flat line 212) is selected to capture places where the primary and secondary traces 206, 208 deviate from each other significantly, i.e., the flow oscillation amplitude is greater than the entry threshold value ($T_1$) consistently. The reversion zone flag is indicated by trace R. Referring to FIG. 3, the reversion zone flag is one (R=1) at regions 216, 218 and 220 and reversion zone flag is zero (R=0) otherwise. Note that at region 222, the primary and secondary traces 206, 208 do not deviate from each other significantly, thus the reversion zone flag is zero (R=0).

The exit threshold value ($T_2$) may be selected to be a specific amount less than the entry threshold value ($T_1$). In one example, the exit threshold value ($T_2$) is selected to be about 10% less than the entry threshold value ($T_1$). In one example, 10 grams per second is the entry threshold value ($T_1$) and 8 grams per second is the exit threshold value ($T_2$). In another example, 30 grams per second is the entry threshold value ($T_1$) and 25 grams per second is the exit threshold value ($T_2$).

In summary, the method 100 allows for real-time identification of regions where airflow pulsation and reversion is sufficient to result in erroneous readings from the mass air flow sensor 22. As described above, the method 100 detects airflow pulsation or sustained inter-event flow oscillations, measured by the mass air flow sensor 22, as an indication of reverse airflow. The method 100 detects the size of the oscillations and a calibration test is performed to determine what level of oscillation will produce an unreliable reading. Since method 100 is not dependent on the engine system 12, only one calibration test is needed for each mass air flow sensor 22. Since the same mass air flow sensor 22 may be used together with many different engine systems or vehicles, this may reduce the amount of calibrations required for each vehicle.

As noted above, the controller 50 of FIG. 1 may include a computing device that employs an operating system or processor 52 and memory 54 for storing and executing computer-executable instructions. Computer-executable instructions may be compiled or interpreted from computer programs created using a variety of programming languages and/or technologies, including, without limitation, and either alone or in combination, Java™, C, C++, Visual Basic, Java Script, Perl, etc. In general, a processor 52 (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which may constitute a main memory. Such instructions may be transmitted by one or more transmission media, including coaxial cables, copper wire and fiber optics, including the wires that comprise a system bus coupled to a processor of a computer. Some forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Look-up tables, databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store may be included within a computing device employing a computer operating system such as one of those mentioned above, and may be accessed via a network in any one or more of a variety of manners. A file system may be accessible from a computer operating system, and may include files stored in various formats. An RDBMS may employ the Structured Query Language (SQL) in addition to a language for creating, storing, editing, and executing stored procedures, such as the PL/SQL language mentioned above.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. An engine system comprising:

an engine having at least one cylinder;

at least one fuel injector configured to selectively inject a fuel into the at least one cylinder;

a manifold absolute pressure sensor configured to provide a real-time MAP signal during an intake event of the engine;

an intake valve operatively connected to the engine, the intake event being a time period from just before the intake valve opens to just after the intake valve closes;

a mass air flow sensor configured to generate a set of mass air flow readings based on an airflow through the mass air flow sensor during the intake event, the set of mass air flow readings having a maximum value and a minimum value;

a controller operatively connected to the mass air flow sensor and the manifold absolute pressure sensor and having a processor and tangible, non-transitory memory on which is recorded instructions;

wherein execution of the instructions by the processor causes the controller to:

determine whether a rate of change in the real-time MAP signal is greater than or equal to a predetermined transient threshold value ($T_0$);

if the change in the real-time MAP signal is less than the predetermined transient threshold value ($T_0$), set a delta factor (D) as the difference between the maximum value and the minimum value of the set of mass air flow readings;

wherein the controller is configured to set up a reversion zone flag (R) such that presence of the reversion is indicated by the reversion zone flag being one (R=1) and absence of the reversion is indicated by the reversion zone flag being zero (R=0);

if the delta factor (D) is greater than or equal to an entry threshold value for at least a first number of consecutive intake events, the controller is configured to set the reversion zone flag to one (R=1);

if the delta factor (D) is less than or equal to an exit threshold value for at least a second number of consecutive intake events, the controller is configured to set the reversion zone flag to zero (R=0); and wherein the controller is configured to control the engine by adjusting a flow of the fuel injected by the fuel injector based in part on a value of the reversion zone flag (R).

2. The system of claim 1, wherein:

if the delta factor (D) is greater than or equal to the entry threshold value for less than the first number of consecutive intake events, the controller is configured to make no change to the reversion zone flag.

3. The system of claim 2, wherein the first number of consecutive intake events is three.

4. The system of claim 1, wherein:

if the delta factor (D) is less than or equal to the exit threshold value for less than the second number of consecutive intake events, the controller is configured to make no change to the reversion zone flag.

5. The system of claim 4, wherein the second number of consecutive intake events is four.

6. The system of claim 1, wherein the vehicle includes a throttle valve and wherein:

if the rate of change of the real-time MAP signal is greater than or equal to the predetermined transient threshold value ($T_0$), the controller is configured to determine if a predefined open throttle condition is met; and if the predefined open throttle condition is met, the controller is configured to set the reversion zone flag to zero (R=0).

7. The system of claim 6, wherein the predefined open throttle condition is defined by the throttle valve being greater than 90% open.

8. The system of claim 6, wherein the predefined open throttle condition is defined by a pressure downstream of the throttle valve being 90% greater than a pressure upstream of the throttle valve.

9. The system of claim 6, wherein:

if the predefined open throttle condition is met, the controller is configured to set the delta factor (D) as the difference between the maximum value and the minimum value of the set of mass air flow readings;

if the delta factor (D) is greater than the entry threshold value for less than the first number of consecutive intake events, the controller is configured to make no change to the reversion zone flag; and if the delta factor (D) is greater than the entry threshold value for at least the first number of consecutive intake events, the controller is configured to set the reversion zone flag to one (R=1).

10. The system of claim 6, wherein:

if the delta factor (D) is less than or equal to the entry threshold value for less than the second number of consecutive intake events, the controller is configured to make no change to the reversion zone flag; and if the delta factor (D) is less than or equal to the exit threshold value for at least the second number of consecutive intake events, the controller is configured to set the reversion zone flag to zero (R=0).

11. The system of claim 1, wherein the exit threshold value is about 10 percent less than the entry threshold value.

12. The system of claim 1, wherein the entry threshold value is at least about 10 grams per second.

13. A method of controlling an engine system having an engine, at least one cylinder, at least one fuel injector configured to selectively inject a fuel into the at least one cylinder, an intake valve and a manifold absolute pressure sensor configured to provide a real-time MAP signal during an intake event and a mass air flow sensor, the method comprising:

determining whether a rate of change in the real-time MAP signal is greater than or equal to a predetermined transient threshold value ($T_0$);

wherein the intake event is a time period from just before the intake valve opens to just after the intake valve closes;

wherein the mass air flow sensor is configured to generate a set of mass air flow readings based on an airflow through the mass air flow sensor during the intake event, the set of mass air flow readings having a maximum value and a minimum value;

if the rate of change in the real-time MAP signal is less than the predetermined transient threshold value ($T_0$), setting a delta factor (D) as the difference between the maximum value and the minimum value;

setting up a reversion zone flag (R) such that presence of the reversion is indicated by the reversion zone flag being one (R=1) and absence of the reversion is indicated by the reversion zone flag being zero (R=0), wherein the reversion zone flag is initialized to zero, via the controller;

determining if the delta factor (D) is greater than or equal to an entry threshold value for at least a first number of consecutive intake events;

if the delta factor (D) is greater than or equal to the entry threshold value for at least the first number of consecutive intake events, setting the reversion zone flag to one (R=1);

determining if the delta factor (D) is less than or equal to an exit threshold value for at least a second number of consecutive intake events;

if the delta factor (D) is less than or equal to the exit threshold value for at least the second number of consecutive intake events, setting the reversion zone flag to zero (R=0); and controlling the engine by adjusting a flow of the fuel injected by the fuel injector, based in part on a value of the reversion zone flag (R).

14. The method of claim 13, further comprising:

if the delta factor (D) is greater than or equal to the entry threshold value for less than the first number of consecutive intake events, making no change to the reversion zone flag.

15. The method of claim 13, further comprising:

if the delta factor (D) is less than or equal to the exit threshold value for less than the second number of consecutive intake events, making no change to the reversion zone flag.

16. The method of claim 13, wherein the engine system includes a throttle valve and further comprising:

if the rate of change of the real-time MAP signal is greater than or equal to the predetermined transient threshold value ($T_0$), determining if a predefined open throttle condition is met;

wherein the predefined open throttle condition is defined by a minimum opening of the throttle valve;

if the predefined open throttle condition is not met, setting the reversion zone flag to zero (R=0); and if the predefined open throttle condition is met, determining the maximum value and the minimum value of the set of mass air flow readings for each respective intake event and setting the delta factor (D) as the difference between the maximum value and the minimum value.

17. The method of claim 16, wherein the predefined open throttle condition is met when the throttle valve is at least 90% open.

18. The method of claim 13, wherein the entry threshold value is at least about 10 grams per second.

19. The method of claim 13, further comprising:

obtaining a first trace from the mass air flow sensor during multiple intake events;

obtaining a second trace from a calibration sensor during the multiple intake events, the calibration sensor being unaffected by reversion;

obtaining a third trace as a difference between the first trace and the second trace, via the controller; and setting the entry threshold value as about half of a highest value of the third trace, via the controller.

* * * * *